US006061036A

United States Patent [19]

MacDonald, Jr. et al.

[11] Patent Number: 6,061,036

[45] Date of Patent: May 9, 2000

[54] RIGID AND FLEXIBLE ANTENNA

[75] Inventors: James D. MacDonald, Jr.; Walter M. Marcinkiewicz, both of Apex; Gerard James Hayes, Wake Forest; John Michael Spall, Raleigh, all of N.C.

[73] Assignee: Ericsson, Inc., Research Triangle Park, N.C.

[21] Appl. No.: 09/017,660

[22] Filed: Feb. 3, 1998

[51] Int. Cl.[7] ..... H01Q 1/24

[52] U.S. Cl. ..... 343/873; 340/572; 343/872; 343/702

[58] Field of Search ..... 343/702, 873, 343/700 MS, 872; 340/572

[56] References Cited

U.S. PATENT DOCUMENTS

| | | | |
|---|---|---|---|
| 4,435,713 | 3/1984 | Gasparaitis et al. | 343/702 |
| 4,755,820 | 7/1988 | Backhouse et al. | 343/700 MS |
| 4,931,805 | 6/1990 | Fisher | 343/715 |
| 5,229,784 | 7/1993 | Jones | 343/888 |
| 5,479,178 | 12/1995 | Ha-Dong | 343/702 |
| 5,528,222 | 6/1996 | Moskowitz et al. | 340/572 |
| 5,646,635 | 7/1997 | Cockson et al. | 343/702 |
| 5,828,342 | 10/1998 | Hayes et al. | 343/702 |

FOREIGN PATENT DOCUMENTS

| | | |
|---|---|---|
| 0613206A | 8/1994 | European Pat. Off. . |
| WO9638879 | 12/1996 | WIPO . |
| WO9638881 | 12/1996 | WIPO . |
| WO9638882 | 12/1996 | WIPO . |
| WO9732356 | 9/1997 | WIPO . |

*Primary Examiner*—Don Wong
*Assistant Examiner*—James Clinger
*Attorney, Agent, or Firm*—Burns, Doane, Swecker & Mathis, L.L.P.

[57] ABSTRACT

A thin flexible antenna has radiating elements made of thin nickel-titanium, a highly flexible and rigid alloy. The radiating elements are covered with silicone elastomer dielectric layers that have suitable elongation properties to withstand extreme bending stresses outer jackets cover the antenna. The outer jackets have a textured exterior surface that evenly distributes the bending stresses across the antenna.

16 Claims, 5 Drawing Sheets

RIGID AND FLEXIBLE ANTENNA

BACKGROUND

This invention generally relates to the field of antennas, more particularly, antennas that are used in small communication devices.

The growth of commercial radio communications and, in particular, the explosive growth of cellular radiotelephone systems has resulted in extensive use and handling of mobile phones by subscribers. One of the important considerations in designing a small communication device, such as a cellular phone, is the physical characteristics of its antenna. Typically, it is desirable to design a small antenna that is flexible enough to withstand day-to-day handling, including occasional mishandling. For example, the antenna should tolerate significant bending stresses that could bend it up to 180° and still return to its original shape when the bending stresses are removed.

Conventional antennas use a radiating element that is overmolded with a resilient material, such as plastic or elastomer, to make it flexible. The radiating element may be comprised of wire, stamped, or etched metal. Etched flexible circuits are also used as the radiating element. Conventional overmolding techniques with plastic or elastomer, however, produce an antenna structure that is difficult to match to the bending and elongation characteristics of the metallic radiating element. Thus, bending the antenna, especially at low or high temperature, produces excessive shear stresses at the interface of the radiating element and the overmolded structure. As a result, current antenna designs often provide limited flexural endurance lifetimes. As a compromise, larger metallic elements and/or overmolded structures are used, with a resulting sacrifice in the size of the antenna. Also, some conventional antennas use relatively rigid metallic sheets, for example, metals in solid sheets, that are placed in various positions on the antenna assembly to produce the antenna's electrical structures, such as ground planes, tuning elements, etc. However, the use of rigid metallic sheets substantially reduces antenna flexibility.

Moreover, some mobile communication devices use retractable antennas. A retractable antenna must be rigid enough to allow for insertion of the antenna into a clearance area without buckling. Conventional antennas employ a circular wire or rod as their primary structure. This rod may serve as a radiating element or merely as a support for the radiating element. Typically, the rod gets inserted into a discrete tube or guiding feature disposed within the housing of the device. Rod shaped antennas, however, require a large clearance area, which reduces the available space for other radio circuitry.

Therefore, there exists a need for a rigid and thin antenna that has superior flexibility.

SUMMARY

The present invention that addresses this need is exemplified in a rigid and flexible retractable antenna that includes flat radiating elements, flexible dielectric layers and textured outer jackets. In one embodiment, the present invention uses dielectric layers of high elongation silicone elastomer, which are disposed between the radiating elements and the outer jackets to evenly distribute the bending stresses along the length of the antenna. Preferably, the radiating element is a flat strip of Nickel-Titanium (Ni—Ti) alloy that provides significant flexural characteristic over conventional metallic radiating elements. In this way, the retractable antenna of the invention is a rigid, thin and highly flexible antenna that can be bent without permanent deformation.

According to some of the more detailed features of the invention, the outer jackets have a textured exterior surface that relieve bending stresses of surface tension and compression. By providing a deep texture at the exterior surfaces, peak bending stresses are lowered by being evenly distributed across the antenna. Also, the outer jackets may include flexible metalized fabrics functioning as ground planes made of nickel and copper. Preferably, the flexible metalized fabric, which may be woven or knit, is bonded with the dielectric layers via silicone adhesive. By applying heat and pressures, the silicone adhesive fills the voids in metalized fabric to enhance bending characteristics of the antenna.

Other features and advantages of the present invention will become apparent from the following description of the preferred embodiment, taken in conjunction with the accompanying drawings, which illustrate, by way of example, the principles of the invention.

DETAILED DESCRIPTION

Figure 1:
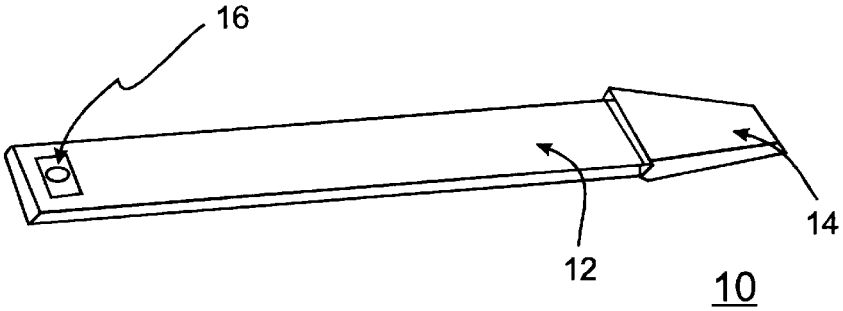
FIG. 1 is an isometric view of the antenna that advantageously uses the present invention.

Referring to FIG. 1, an isometric view of an antenna 10 that is assembled according to the present invention is shown. In an exemplary embodiment, the antenna 10 is a dual band retractable antenna that is used in a mobile communication device, such as a cellular telephone. As its main body, the antenna 10 includes a thin antenna blade 12. A protective molded end cap 14, for example, one made of plastic, is attached to one end of the blade 12. At the other end, a termination contact 16 provides the interface between the antenna 10 and RF circuitry of the communication device (not shown). Termination of the antenna 10 to the RF circuitry may be accomplished through conventional means such as soldering, displacement connectors, conductive elastomers, or metal compression contacts.

Figure 2:
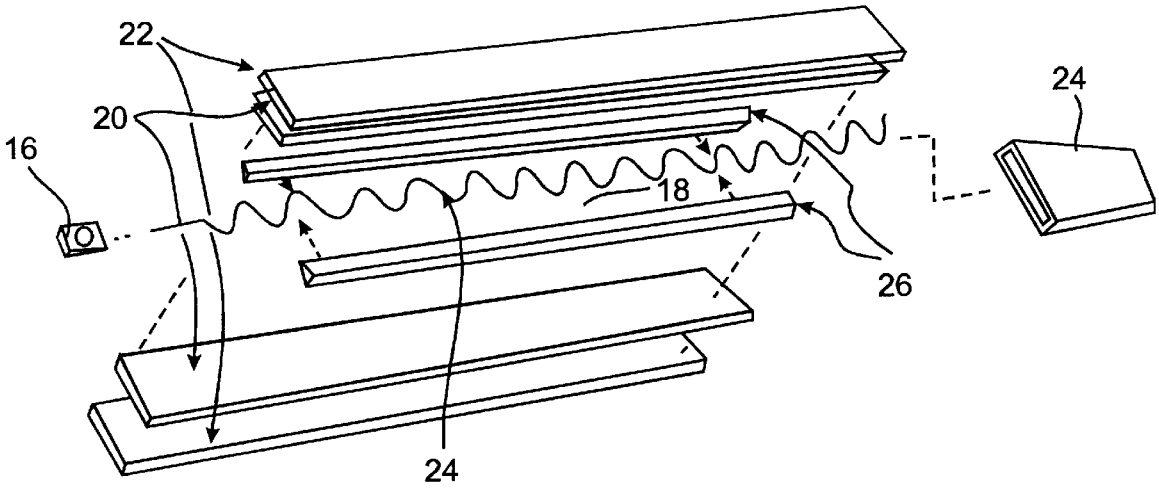
FIG. 2 is an exploded view of the antenna of FIG. 1 according to one embodiment of the invention.

Referring to FIG. 2, an exploded view of the antenna 10 according to one embodiment of the invention is shown. The antenna 10 includes radiating elements 18, dielectric layers 20 and outer jackets 22. Because the antenna 10 is a dual band antenna, the radiating elements 18 include an active element 24 that is coupled to two parasitic elements 26. As shown, the active element 24 is composed of a wire meander, for example, made of round copper wire. Alternatively, the wire meander may be formed by a stamped, etched, plated, or deposited means. For applications requiring a minimum thickness with maximum fatigue endurance in bending, the radiating elements 18 may alternately be formed from metalized fabrics. Preferably, the parasitic elements 26 are made of two unequal strips of Ni—Ti alloys. In this way, the Ni—Ti strips provide for dual band performance of the antenna 10, while providing the structural rigidity that allows the antenna 10 to be retractable.

Figure 3:
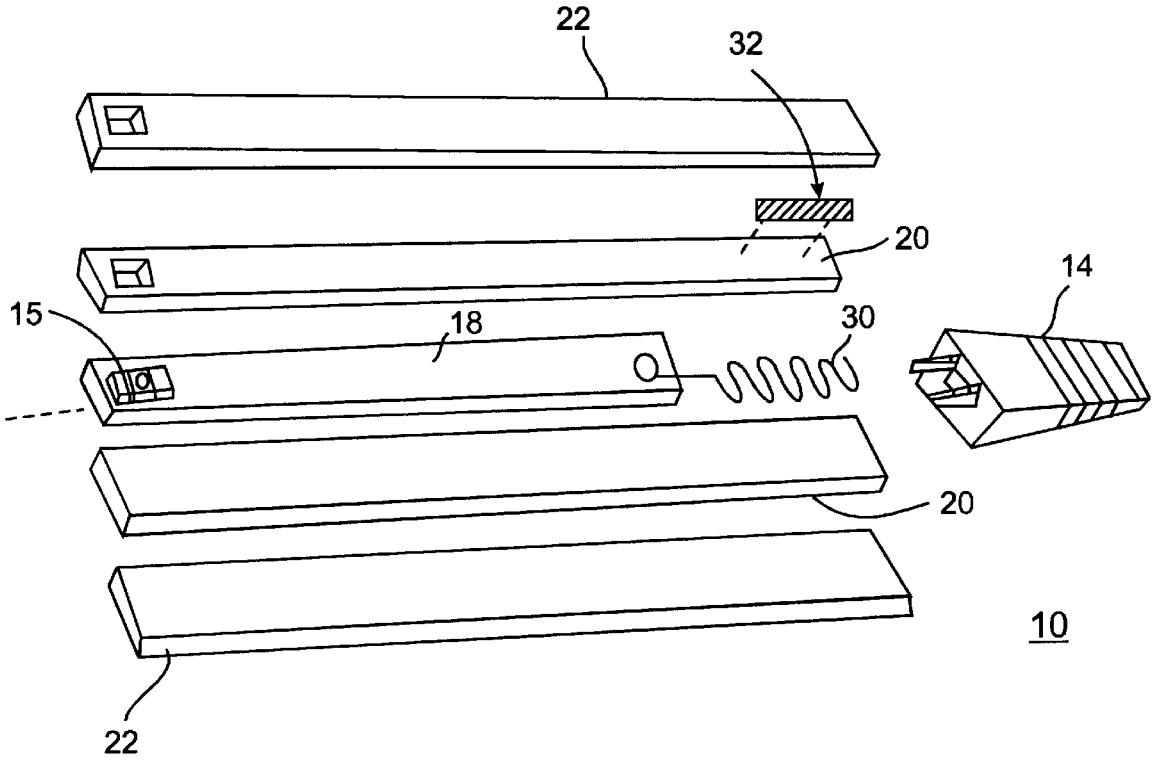
FIG. 3 is an exploded view of the antenna of FIG. 1 according to another embodiment of the invention.

Referring to FIG. 3, an exploded view of the antenna 10 according to another embodiment of the invention is shown. According to this embodiment, the radiating elements 18 include a flat strip of Ni—Ti super flexural alloy 28 rather than a conventional round wire or rod as the primary mechanical structure. The strip 28 terminates in a wire meander 30 in the upper portion of the antenna 10. The wire meander 30 is formed of round copper wire but could also be formed by a stamped, etched, plated, or deposited means. A tuned parasitic metallic element 32 is bonded over the wire meander 30, over one of the dielectric layers 20 covering the radiating elements 18. This structure is used to create a dual band performance and to provide the structural rigidity that makes the antenna 10 a retractable antenna.

According to the invention, the dielectric layers 20 are silicone elastomer dielectric layers that are disposed at opposing surfaces of the radiating elements 18. Because the temperature induced changes in the flexural modulus of silicone are significantly less than those of most common thermoplastic molding elastomers, the silicone elastomer dielectric layers 20 significantly extend flexural endurance of the antenna 10. The silicone elastomer dielectric layers 20 bond with the radiating elements 18 upon application of pressure or heat. Material elongation properties may be varied by compositional changes in the silicone elastomer. For instance, typical silicone elastomer dielectrics are available in formulations that offer 100% to 300% elongation at a given stress level, while still maintaining the same dielectric constant value.

Stiffer dielectric materials may be added over the silicone elastomer dielectric layers 20 to control the flexibility of the antenna 10 or to tailor the dielectric constant of the dielectric layers 20 for a specified characteristic impedance. For example, layers 21 of polyether-imide (PEI) (shown in FIG. 4) may be used, for applications where high strength and maximum flexibility are required. PEI closely matches the dielectric constant of silicone and bonds well to the silicone elastomer dielectric layers 20.

The outer jackets 22 provides an environmentally suitable exterior surface for the antenna 10. For example, woven or knit fabric layers may be used for mechanical reinforcement or abrasion resistance. Matching the flexibility of the radiating elements 18 and the silicone elastomer dielectric layers 20 to that of the outer jackets 22 is accomplished through proper choice of elastomer elongation properties and outer jacket thickness. In applications requiring minimum antenna thickness, a thin layer of fluorinated ethylene propylene (FEP) may also be used.

According to one of the features of the invention, the outer jackets 22 of the antenna 10 have textured exterior surfaces that evenly distribute bending stresses across the antenna. Under this arrangement, the depth and pitch of the texture of the exterior surfaces are optimized for a given cross section to keep bending stresses within fatigue endurance limits for tension, compression, and shear bending forces.

Figure 4:
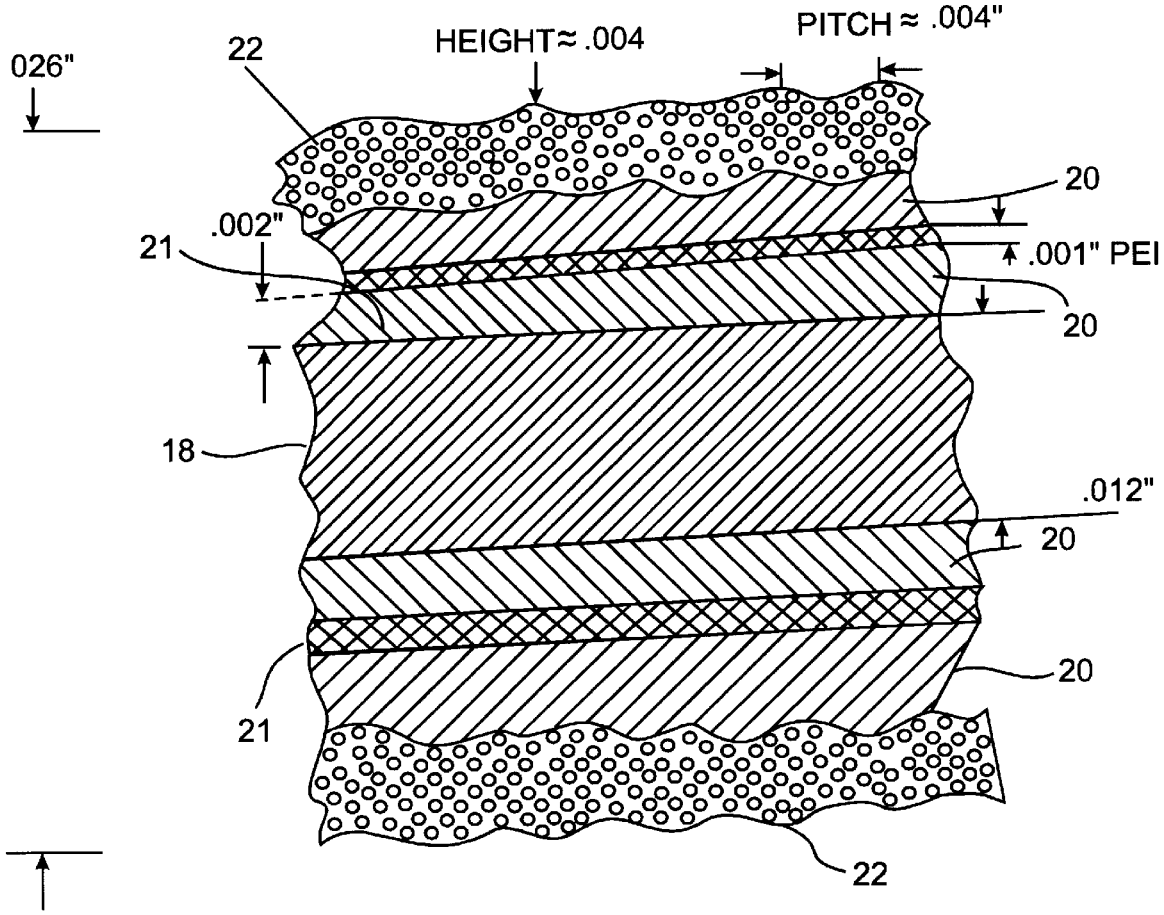
FIG. 4 is a partial cross-sectional view of the antenna according to one embodiment of the invention.

Referring to FIG. 4, a partial cross-sectional view of the antenna 10 shows exemplary dimensions of various layers, including textured exterior surfaces of the jackets 22. As shown, the exemplary textured exterior surfaces have approximately sinusoidal cross sections. It has been determined that the effective dielectric thickness in a structure that has a textured surface is approximately equal to the root-mean-square (RMS) of the height of the cross-section of the texture. The effective thickness of the silicone elastomer dielectric layers 20 are used to produce the specified impedance at a given line width. Under this arrangement, this thickness may be varied throughout the antenna, to produce controlled impedance for antenna structures formed by strip lines or microstrips. Using well known formulas, the specified characteristic impedance ($Z_0$) of an RF transmission line is calculated from the geometry and the dielectric constant of the materials comprising the line. Depending on whether the geometry creates a strip line or microstrip transmission line (both types may be used in practical antennas) different formulas are used.

In this way, the textured outer surface lowers bending stresses by providing a more compliant structure without seriously compromising the specified characteristic impedance or raising dielectric loss values. The outer texture surface is created during bonding and curing of the antenna using well known techniques. Under one technique, a selected texture is created by pressure pads used in the curing process. The texture is first created on the mating surface of the pressure pads and transferred to the antenna element surface with heat and pressure during the cure cycle.

Figure 5:
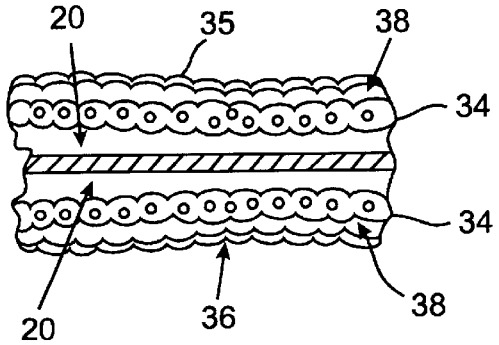
FIG. 5 is a partial cross-sectional view according to another embodiment of the invention.

Referring to FIG. 5, a partial cross sectional view of the antenna 10 according to another embodiment of the invention is shown. Under this embodiment, the outer jackets include flexible metalized fabric layers 34 that function as ground planes of the antenna 10 and exterior layers 36 that provide the textured exterior surfaces of the antenna. The metalized fabric layers 34 are chosen for strength and high temperature processing capability. Preferably, the metalized fabric layers are made of a copper and nickel alloy disposed in polyester or liquid crystal polymer (LCP) type cloth that provide the exterior layers 36. An exemplary, flexible metalized fabric that can be used in the antenna of the present invention is known as Flectron® manufactured by Amsbury Group, which is a 0.006" (nominal) thick polyester woven fabric. Preferably under this embodiment, the exterior layers 36 and the metalized fabric layers 34 are bonded to each other by layers of silicon adhesive 38.

The present invention uses silicone elastomer adhesive to bond all layers and provide bending stress relief between signal, dielectric, and ground planes. The exterior surfaces of the outer jackets 22, may be thermoplastic elastomer, or similar abrasion resistant flexible material. The silicone dielectric layers 20 provide consistent flexibility with high elongation over temperature, particularly at low temperatures, which prevents the fracture of metalized fabric layers during flexing. Pressure is applied during the curing of the silicone adhesive to ensure that the silicone completely fills all voids between the fibers of the metalized fabric. Additionally, bonding of the silicone elastomer dielectric layers 20 to the radiating elements 18 may use various heat activated bonding films, such as tetrafluoroethylene TFE or FEP to match the electrical and mechanical performance requirements of a specific structure. The use of a silicone adhesive provides sufficient adhesion to low surface energy dielectrics, such as TFE, PEI, or perfluoro alkoxy alkane (PFA) used in the current invention. This is because fluorinated or fluorine terminated (fluoride) materials do not easily bond chemically, except with silicon elastomer adhesives. Further bond enhancements may be achieved by either adding silicon silane adhesion promoter to the silicon elastomer adhesive or by using oxygen plasma pretreatment of the fluorinated materials.

The antenna 10 is designed to keep bending stresses within the fatigue endurance limit of the silicone elastomer dielectric layers 20. More specifically, for a given cross section that produces the specified characteristic impedance, a natural bending radius and resulting stress levels for chosen materials are determined by either physical models (experimentally), beam bending calculations (explicit solution), or finite element analysis (FEA). These stress levels exhibit a maximum value which is below the failure limit for the anticipated number of flexural reversals caused by bending. Charts for material fatigue endurance are generally given as a failure line plot of the stress level versus the number of stress reversals (referred to as "S/N" charts). As described above, for the specified characteristic impedance, the present invention manipulates elongation properties of the dielectric layer and texturing of the exterior surface of the outer jackets 22 to maintain bending stress levels below fatigue endurance of the antenna 10.

Figure 6A:
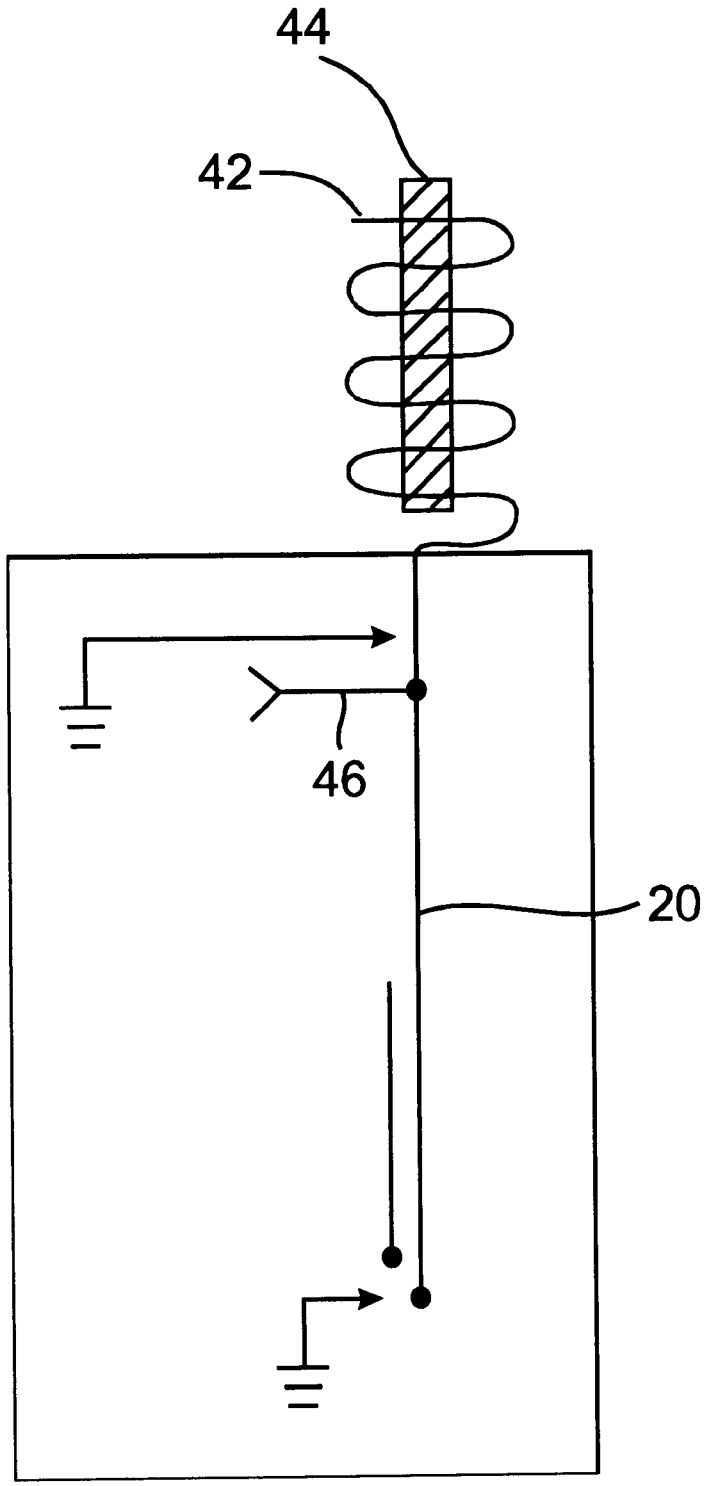
FIGS. 6(*a*) and 6(*b*) are diagrams of a mobile station showing the antenna of the present invention in retracted and extended positions, respectively.
Figure 6B:
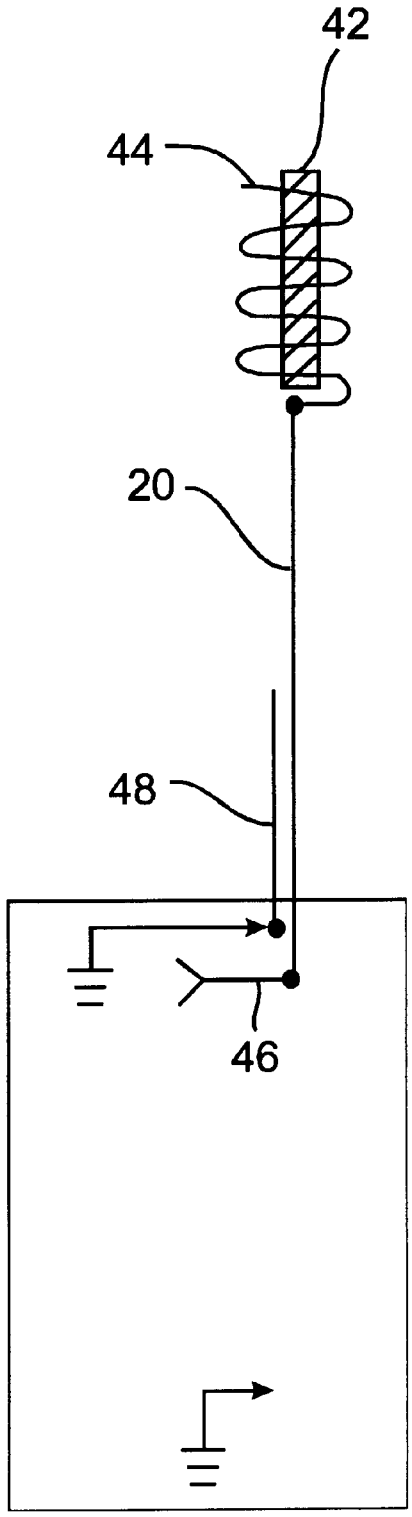

Referring to FIGS. 6(*a*) and 6(*b*) show a portable communication device that uses the antenna 10 of the present invention in a retracted position and an extended position, respectively. As shown in FIG. 6(*a*), when the antenna is retracted, only top wire meander 42 and parasitic element 44 are exposed. Under this arrangement, the meander pattern is trimmed (sized) to form a quarter wave length ($\lambda/4$) radiating element at 800 MHZ band. The result is a 50Ω input impedance that can be connected to an RF feed 46. For dual-band operation, the parasitic element 44 couples across the wire meander 42 at the higher-band, while not impacting the lower band. The parasitic element 44 is placed across the wire meander 42 to form a 50Ω input impedance. Depending on its length, the Ni—Ti strip 20 may or may not be grounded at the ends.

As shown in FIG. 6(*b*), when the antenna is extended, the Ni—Ti strip 20 is exposed in series with the wire meander 42 to form a half wavelength ($\lambda/2$) radiator at 800 MHZ. The end of the Ni—Ti strip 20 is connected to the RF feed 46, typically with a matching network. For dual-band operation, a ground trace 48 parallel to the Ni—Ti strip 20 is added. The separation and length are adjusted until the dual-band (50Ω input) response is achieved at the higher-band of operation.

From the foregoing description it would be appreciated that a thin and flexible antenna for use in a small communication device is disclosed. The use of flexible dielectric and metalization materials produces an antenna which may repeatedly flexed in normal use. Thin films of dielectric adhesive and flexible metalization are used to laminate the antenna structure. This technique produces a structure which can be easily tailored to produce repeatable controlled impedance characteristics. The bending radius and flexibility of the structure is easily controlled with proper selection of materials. This method of construction is capable of forming a very thin antenna blade and lends itself to high volume automated production.

Although the invention has been described in detail with reference only to the presently preferred embodiment, those skilled in the art will appreciate that various modifications can be made without departing from the invention. Accordingly, the invention is defined only by the following claims which are intended to embrace all equivalents thereof.

What is claimed is:

1. An antenna, comprising:

a radiating element;

a silicon elastomer dielectric layer bonded to the radiating element; and an outer jacket providing an exterior surface for the antenna, wherein said silicon elastomer is disposed between the radiating element and the outer jacket for evenly distributing bending stresses along the length of the antenna.

2. The antenna of claim 1, wherein the radiating element includes a nickel-titanium alloy.

3. The antenna of claim 1, wherein the radiating element includes an active element and a parasitic element, wherein the parasitic element is made of nickel-titanium alloy.

4. The antenna of claim 1, wherein the outer jacket has a textured exterior surface that substantially distributes bending stresses across the antenna.

5. The antenna of claim 1, wherein the outer jacket includes a flexible metalized fabric.

6. The antenna of claim 5, wherein the flexible metalized fabric is made of nickel and copper.

7. The antenna of claim 1, wherein said silicone elastomer dielectric layer is bonded to the radiating element by a heat activated bonding film.

8. The antenna of claim 1, wherein the silicone elastomer dielectric layer is bonded to the outer jacket by a silicone adhesive.

9. A flat antenna, comprising:

radiating elements including an strip of Nickel-Titanium alloy;

silicon elastomer dielectric layers bonded to opposite surfaces of the radiating element; and outer jackets providing exterior surfaces for the antenna, wherein the outer jackets have textured exterior surfaces that substantially distribute bending stresses across the antenna.

10. The flat antenna of claim 9, wherein the radiating elements include an active element and parasitic elements.

11. The flat antenna of claim 9, wherein the outer jackets include corresponding flexible metalized fabric layers functioning as ground planes for the antenna and exterior layers providing the textured exterior surfaces.

12. The flat antenna of claim 9, wherein the metalized fabric layers are made of nickel and copper.

13. The flat antenna of claim 10, wherein the silicon elastomer dielectric layers are bonded to the radiating elements by heat activated bonding films.

14. The flat antenna of claim 10, wherein the metalized fabric layers and exterior layers are bonded to each other by silicone adhesive layers.

15. The flat antenna of claim 10, wherein the exterior layers are made of polyester cloth.

16. The flat antenna of claim 10, wherein the exterior layers are made of liquid crystal polymer cloth.

* * * * *